United States Patent [19]

Grigas

[11] 4,381,806

[45] May 3, 1983

[54] YARN CLAMP

[75] Inventor: Daniel P. Grigas, South Dennis, Mass.

[73] Assignee: Crompton & Knowles Corporation, New York, N.Y.

[21] Appl. No.: 239,225

[22] Filed: Feb. 27, 1981

[51] Int. Cl.[3] ..... D03D 47/34

[52] U.S. Cl. ..... 139/450; 139/429

[58] Field of Search ..... 139/437, 450, 452, 429; 188/25, 37

[56] References Cited

U.S. PATENT DOCUMENTS 3,915,199 10/1975 Kida ..... 139/452

4,192,357 3/1980 Tanaka et al. ..... 139/450

4,338,975 7/1982 Porter ..... 139/452

*Primary Examiner*—Henry Jaudon

*Assistant Examiner*—Steven N. Meyers

*Attorney, Agent, or Firm*—Howard G. Garner

[57] ABSTRACT

A yarn clamp for periodically clamping yarn on textile machines comprising a pair of clamping rollers supported on a frame for rotation about their axes. Means is provided for moving the clamping rollers into and out of contact with each other and for imparting a partial rotation to each of the rollers while they are out of contact. A wiping means is provided for wiping the surfaces of the clamping rollers when they rotate to avoid the accumulation of lint on the surfaces of the clamping rollers.

6 Claims, 6 Drawing Figures

YARN CLAMP

BACKGROUND OF THE INVENTION

The invention relates generally to a clamp for clamping a continuous yarn in a textile machine in which the yarn moves intermittently and axially. The invention is particularly directed to a yarn clamp for the weft yarn in an outside filling supply loom in which the weft yarn is advanced intermittently along its longitudinal axis from a weft yarn storage means to a weft yarn inserting means. In outside filling supply looms, the weft yarn is drawn from a supply package and stored in the weft storage means. At the time of weft insertion, the stored weft yarn is drawn from the storage means by the weft inserting means and inserted into the loom. In looms of this type, it is essential that the weft yarn is clamped between the weft storage means and the weft inserting means. Various types of clamping devices have been used for this purpose such as those shown in the following U.S. Pat. Nos. 3,575,217, Pfarrwaller issued Apr. 20, 1971; U.S. Pat. No. 3,865,149, Keldany issued Feb. 11, 1975; U.S. Pat. No. 3,916,935, Keldany issued Nov. 4, 1975; and U.S. Pat. No. 4,190,089 Cyvas issued Feb. 26, 1980.

In each of the above patents, the clamping means comprises a pair of plate-like elements, one of which is movable toward and away from the other. The weft yarn passes between these two plate-like elements and is clamped when the movable element moves against the fixed element.

A major problem arises in the use of the prior art weft yarn clamping means due to the fibrous nature of weft yarns. Loose fibers in the form of lint accumulates on the jaws of the clamp and prevents the clamp from gripping the weft yarn properly and periodically the accumulation of lint is drawn into the loom during a weft inserting sequence and this causes a defect in the cloth. These difficulties, experienced with the prior art clamping devices, have been obviated by the present invention.

It is, therefore, a principle object of the present invention to provide a yarn clamp in which lint build-up between the clamping elements is prevented.

Another object of the invention is the provision of a yarn clamp which is self-cleaning.

With these and other objects in view, as will be apparent to those skilled in the art, the invention resides in the combination of parts set forth in the specification and covered by the claims appended hereto.

SUMMARY OF THE INVENTION

The invention comprises a yarn clamp which uses a pair of rollers as the clamping elements. These rollers are mounted for rotation on axles supported by a frame. One of the axles is generally fixed in the frame whereas the other is supported by the frame for movement towards and away from the fixed axle, to move the roller mounted thereon into, and out of, contact with the other roller. The clamp is used in textile machines, such as looms or knitting machines, which requires yarn to be fed periodically. Actuating means, operating in timed relation with the textile machine, moves the movable roller into and out of engagement with the stationary roller so that the rollers are separated just prior to and during the feeding of the yarn and engaged between such feedings of the yarn to clamp it. Means are also provided for rotating the rollers and for wiping the annular clamping surfaces of the rollers so as to remove any lint that may be accumulated on such surfaces.

More specifically, the means for rotating the rollers comprise a pawl and ratchet mechanism that is operated by the actuating means, for imparting a partial rotation to each of the rollers during each movement of the movable roller away from the stationary roller.

BRIEF DESCRIPTION OF THE DRAWINGS

The character of the invention, however, may be best understood by reference to one of its structural forms, as illustrated by the accompanying drawings, in which.

DETAILED DESCRIPTION OF THE INVENTION

Figure 1:
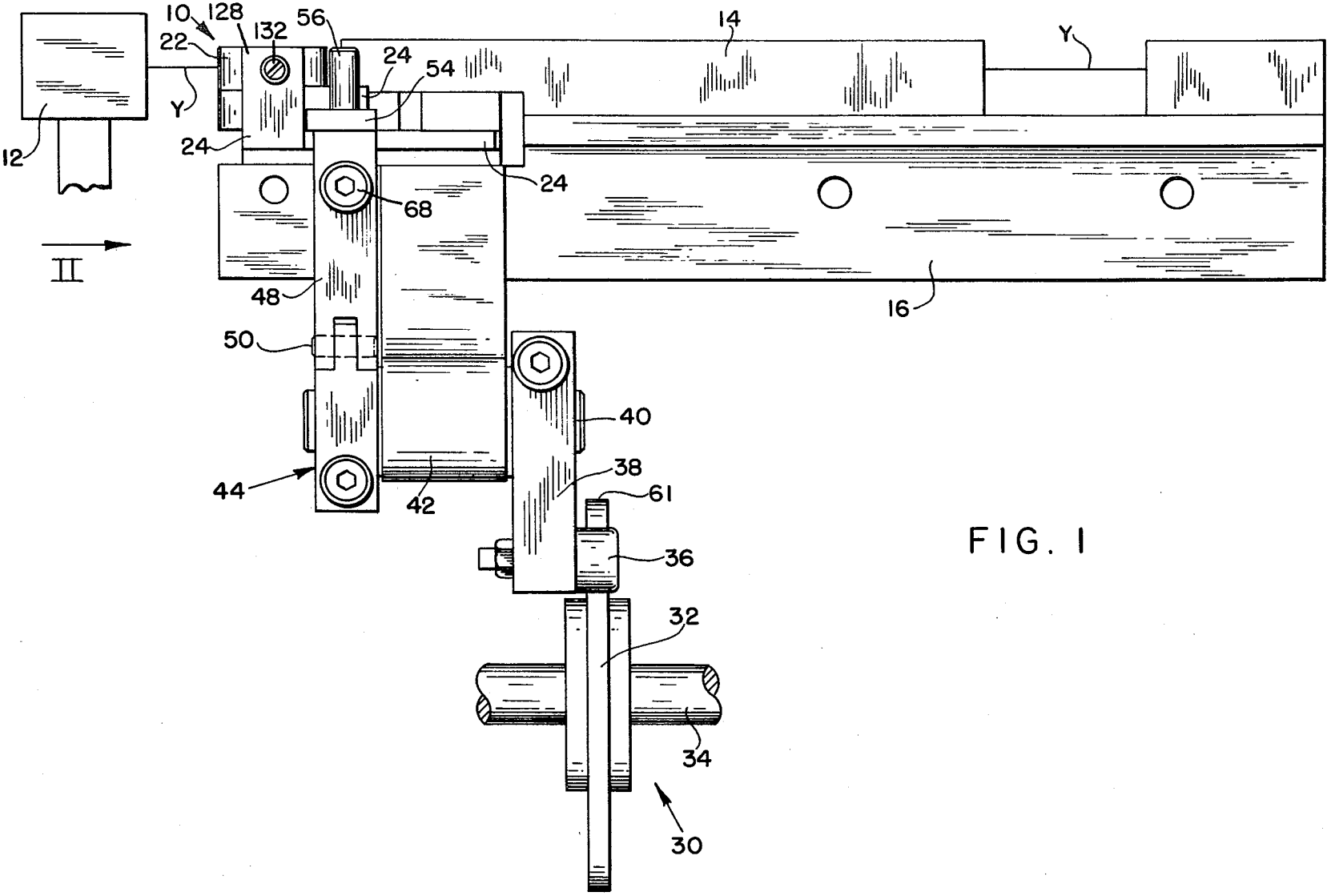
FIG. 1 is a front elevational view of the yarn clamp of the present invention and is located between the weft storage means and the weft inserting means of a loom.
Figure 2:
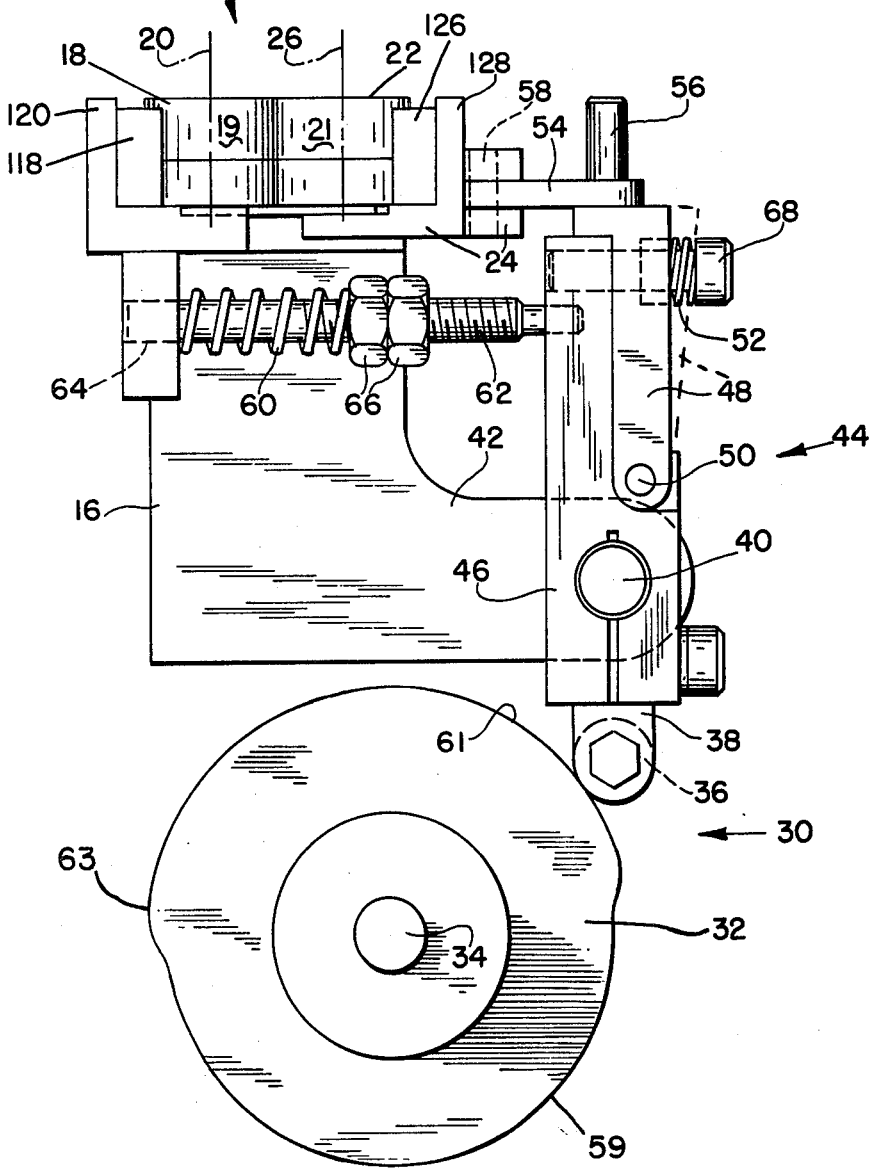
FIG. 2 is a side elevational view of the yarn clamp, looking in the direction of arrow II in FIG. 1.
Figure 3:
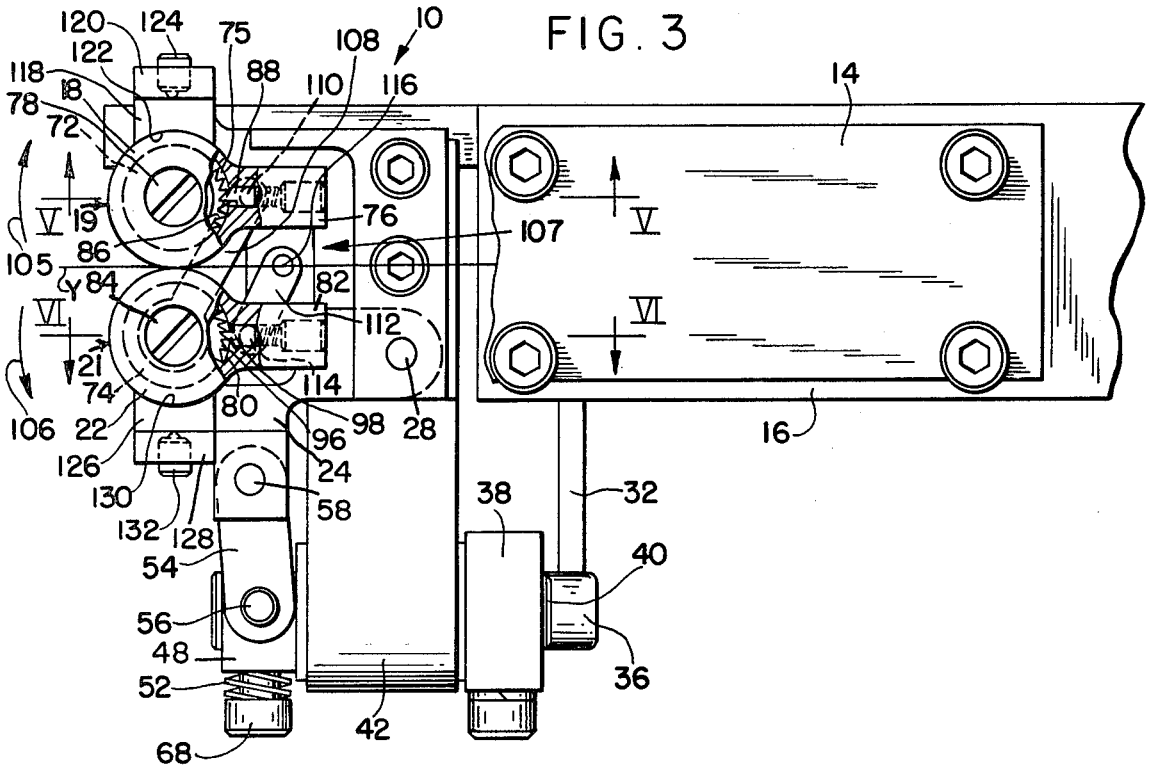
FIG. 3 is an enlarged plan view of the yarn clamp, showing the clamp in the closed position.
Figure 4:
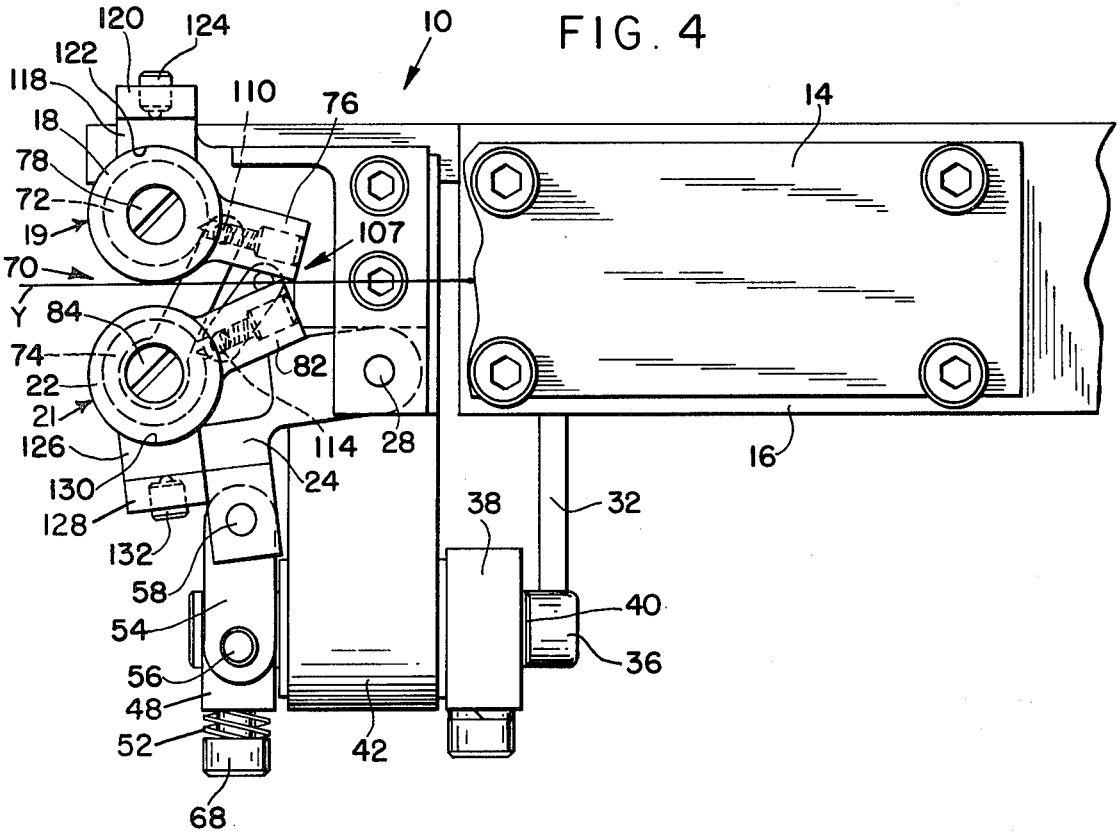
FIG. 4 is a plan view similar to FIG. 3, but showing the yarn clamp in the open position.

Referring first to FIGS. 1, 2, 3 and 4 which best show the general features of the invention, the yarn clamp, indicated generally by the reference numeral 10, is shown located between a weft yarn inserting means 12 and a weft yarn storage means 14 of an outside filling supply loom (not shown). The yarn clamp 10 comprises a first clamping roller 18 mounted for rotation about a first vertical axis 20 on a supporting frame 16. Roller 18 has a first annular clamping surface 19 which is concentric with the axis 20. A second clamping roller 22 is mounted for rotation about a second vertical axis 26 on a horizontal lever 24. Roller 22 has a second annular clamping surface 21 which is concentric with the axis 26. Lever 24 is pivotally mounted on supporting frame 16 by means of a pivot pin 28 (see FIG. 3) so that oscillation of the lever 24 about the pivot pin 28 causes the second clamping roller 22 to be moved toward and away from the first clamping roller 18. FIGS. 1, 2 and 3 show the clamping rollers in a closed position, whereby a weft yarn Y that extends between the weft yarn inserting means 12 and the weft yarn storage means 14 is clamped between the annular clamping surfaces 19 and 21 of the clamping rollers 18 and 22, respectively. FIG. 4 shows the unclamped or open position of the clamping rollers, whereby the clamping surfaces 19 and 21 are spaced from each other and the weft yarn Y is free to be drawn from the storage means 14 by the weft yarn inserting means 12.

The means for actuating the lever 24 to bring the second clamping roller 22 into and out of engagement with the first clamping roller 18 is a cam mechanism generally indicated by the reference numeral 30 (See FIGS. 1 and 2). Cam mechanism 30 comprises a cam 32 mounted for rotation with a drive shaft 34 which forms part of the loom driving mechanism. A follower roller 36 is rotatably mounted on the lower portion of a vertical lever 38. The upper portion of lever 38 is fixed to one end of a horizontal stub shaft 40 rotatably mounted in a forwardly-extending portion 42 of the frame 16. A two-part vertical lever, generally indicated by the reference numeral 44, is mounted on the opposite end of stub shaft 40 and comprises a lower portion 46 fixed to the stub shaft 40 and an upper portion 48 pivotally mounted on the lower portion 46 by means of a pivot pin 50. A compression spring 52 urges the upper portion 48 against the lower portion 46 so that lever 44 normally functions as a unitary lever. A link 54 connects the lever 44 to the lever 24. One end of the link 54 is pivotally attached to the upper portion 48 by means of a pivot pin 56 and the opposite end of link 54 is pivotally connected to the lever 24 by means of a pivot pin 58. The lever 44 is biased in the forward position by means of a compression spring 60 which maintains the follower roller 36 in engagement with the outer working surface 61 of the cam 32. Working surface 61 comprises a low portion 59 and a high portion 63.

When the follower 36 is engaged with the low portion 59 of the cam 32, lever 44 is rocked clockwise as viewed in FIG. 2, by the spring 60 so that the clamping roller 22 is moved away from the clamping roller 18 as shown in FIG. 4. When the cam follower roller 36 is engaged with the high portion 63 of the cam 32, vertical lever 44 is rocked counter-clockwise, as viewed in FIG. 2, against the bias of the spring 60 so that the clamping roller 22 is moved into engagement with the clamping roller 18, as shown in FIG. 3. The spring 60 is loosely mounted on a guide rod 62 that extends between the vertical lever 44 and the supporting frame 16. One end of the guide rod 62 is fixed to the vertical lever 44. The opposite end of guide rod 62 is guided for axial movement in a hole 64 in the supporting frame, as shown in FIG. 2. A pair of nuts 66 are threadingly mounted on the forward end of the guide rod 62 for adjusting the tension of the spring 60.

The upper end of the pivot pin 56 extends above the link 54 to a considerable degree so as to provide a means by which the upper portion 48 may be manually pivoted about pin 50 on the lower portion 46 of the two part lever 44 against the bias of the spring 52. In this way, the upper portion 48 may be pulled away from the lower portion 46 about pivot pin 50 to the dotted-line position as shown in FIG. 2. By moving upper portion 48 to the dotted-line position, the clamping roller 22 is moved out of engagement with the clamping roller 18. The amount of movement of the upper portion 48 away from the lower portion 46 is limited by a screw 68 which extends freely through the upper portion 48 and is threaded into the lower portion 46. Also, the screw 68 is used to adjust the biasing force of the spring 52.

Figure 5:
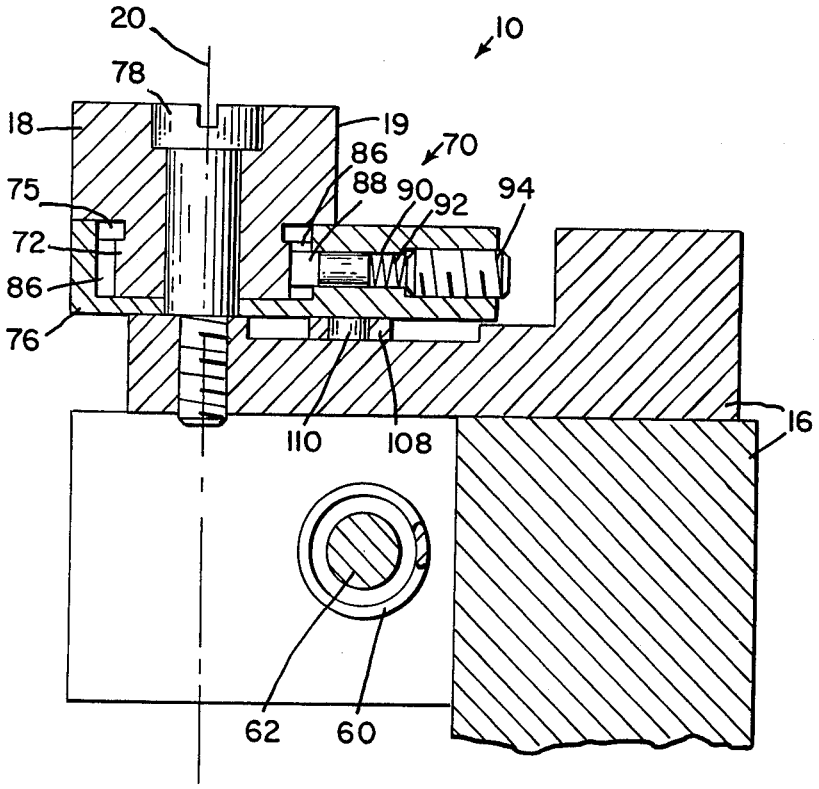
FIG. 5 is a vertical sectional view of the yarn clamp on an enlarged scale and taken on the line V—V of FIG. 3.
Figure 6:
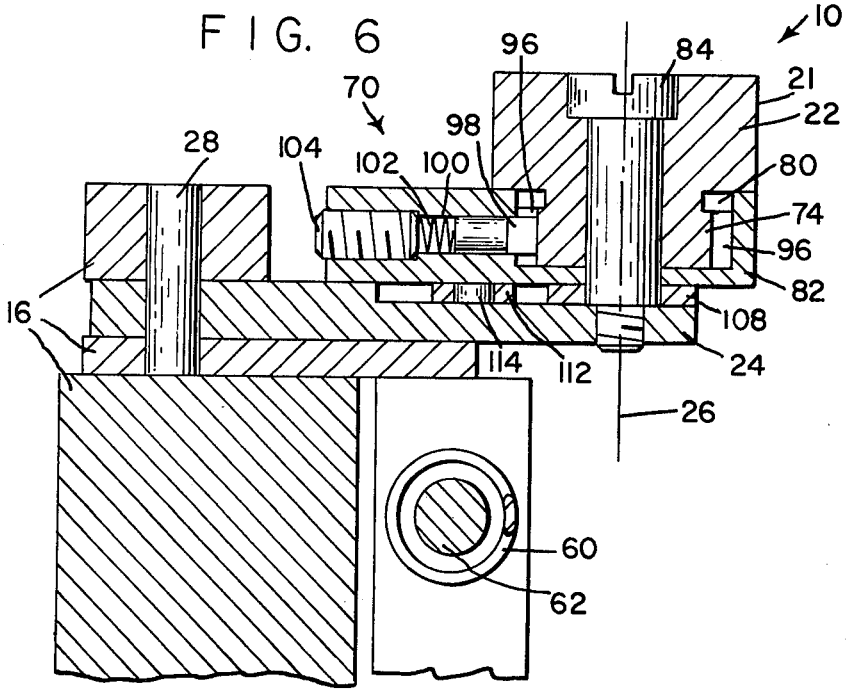
FIG. 6 is a vertical sectional view of the yarn clamp on an enlarged scale and taken on the line VI—VI of FIG. 3.

Referring to FIGS. 3, 5, and 6, there is shown a pawl and ratchet mechanism generally indicated by the reference numeral 70 for providing incremental rotational movement to clamping rollers 18 and 22, respectively. Pawl and ratchet mechanism 70 comprises a first ratchet wheel 72 integrally formed with clamping roller 18 and a second ratchet wheel 74 integrally formed with clamping roller 22.

Referring particularly to FIGS. 3 and 5, clamping roller 18 sets on top of a first arm 76 and the ratchet wheel 72 extends downwardly into an annular cavity 75 in the first arm 76. Clamping roller 18 and arm 76 are mounted to the supporting frame 16 by means of a screw or axle 78. Screw 78 is screwed into the supporting frame 16. However, roller 18 and arm 76 are free to rotate relative to the screw or axle 78 and relative to each other. The vertical axis 20 extends through the center of the screw or axle 78. The annular periphery of the first ratchet wheel 72 is provided with a plurality of teeth 86 which are engaged by a pawl 88. Pawl 88 is mounted in a bore 90 in arm 76 for axial movement toward and away from the teeth 86 in a direction transversely of the vertical axis 20. Pawl 88 is urged into engagement with the teeth 86 by means of a compression spring 92. The tension of the spring 92 is adjusted by means of an adjusting screw 94.

Referring particularly to FIGS. 3 and 6, clamping roller 22 sets on top of a second arm 82 and the ratchet wheel 74 extends downwardly into an annular cavity 80 in arm 82. Clamping roller 22 and arm 82 are mounted to the lever 24 by means of a screw or axle 84. Screw or axle 84 is screwed into the lever 24. However, roller 22 and arm 82 are free to rotate relative to the screw or axle 84 and relative to each other. Vertical axis 26 extends through the center of the screw or axle 84. The annular periphery of the ratchet wheel 74 is provided with a plurality of teeth 96 which are engaged by a pawl 98. Pawl 98 is mounted in a bore 100 in arm 82 for sliding axial movement toward and away from the teeth 96 in a direction which is transverse to vertical axis 26. Pawl 98 is urged into engagement with teeth 96 by means of a compression spring 102. The tension of spring 102 is adjusted by means of an adjusting screw 104. As best illustrated in FIG. 3, the teeth of ratchet wheels 72 and 74 and pawls 88 and 98, respectively, are shaped so that relative movement of the pawl about the toothed periphery of the ratchet wheel in one direction rotates the ratchet wheel. Relative movement of the pawl in the opposite direction enables the pawl to be pushed away from the teeth of the ratchet wheel against the biasing force of its respective compression spring and slide past the teeth. Ratchet wheel 72 and its integral clamping roller 18 rotate only in a clockwise direction, as indicated by arrow 105 in FIG. 3, while the ratchet wheel 74 and its integral clamping roller 22 rotate only in a counterclockwise direction, as indicated by arrow 106 in FIG. 3.

The drive for the pawls 88 and 98 is best illustrated in FIG. 3. As pointed out hereinbefore, arm 76 and arm 82 are pivotally mounted about screws or axles 78 and 84, respectively. (See FIGS. 5 and 6 for details of the mounting) Arms 76 and 82 are free to revolve around screws 78 and 84. Arm 76 can revolve in a counterclockwise direction without effecting rotation of clamping roller 18 due to the inclination of ratchet teeth 86. However, when arm 76 moves in the clockwise direction as shown by arrow 105, roller 18 will also be moved due to the engagement of pawl 88 with teeth 86 of ratchet wheel 72.

Arm 82 is mounted to pivot about axle 84 and due to the inclination of teeth 96 on ratchet wheel 74, arm 82 can pivot in the clockwise direction relative to the roller 22 without effecting rotation of said roller. However, when arm 82 moves in the counterclockwise direction, roller 22 must rotate with it.

Arm 76 is connected to a first link 108 by means of a pivot pin 110 at a point spaced from vertical axis 20. The opposite end of link 108 is connected to screw 84 so that movement of roller 22 out of contact with the surface of roller 18 will cause arm 76 to pivot about axle or screw 78, thereby imparting a partial rotation to roller 18. As roller 22 is moved back into contact with the surface of roller 18 arm 76 is moved in a counterclockwise direction without rotating roller 18.

Arm 82 has pivotally attached to it a second link 112 at pivot point 114. The opposite end of link 112 is pivotally attached to frame 16 by a pivot pin 116 so that when roller 22 moves out of contact with the surface of roller 18, its movement will impart a counter-clockwise relative movement to arm 82 thereby imparting a partial rotation to roller 22. When roller 22 moves back into contact with the surface of roller 18 arm 82 will pivot about axle or screw 84 in a clockwise direction without rotating roller 22 due to the inclination of the teeth on ratchet 98. Thus it will be seen that whenever rollers 18 and 22 are moved out of contact with each other a partial rotation will be imparted to each of the rollers to cause them to rotate about their respective axis.

Referring particularly to FIGS. 2, 3 and 4, a wiper element 118 is loosely mounted between annular surface 19 of clamping roller 18 and a vertical bracket 120 of frame 16. Wiper element 118 has a concave surface 122 which is urged against annular surface 19 of the first clamping roller 18 by means of a locking screw 124. Locking screw 124 is threaded into the vertical bracket 120 and is of the type which is provided with a spring-loaded plunger that bears against wiper element 118 to urge the wiper element against clamping roller 18 with a slight biasing force. This slight biasing force is sufficient to enable the wiper element to wipe any lint that has accumulated on the annular surface of roller 18 as the roller is rotated past the wiper element 118. The biasing force provided by the locking screw 124 is also sufficient to enable the wiper element 118 to provide a braking force on the clamping roller 18. This braking force on the roller 18 insures that the pawl 88 will slide by the teeth 86 of the ratchet wheel 72 when the pawl 88 is moved in a counter-clockwise direction relative to the teeth. Without this braking force, there would be a tendency for the pawl 88 to rotate the ratchet wheel 72 in both directions for each oscillation of the pawl, particularly in view of the fact that the pawl is biased into engagement with the teeth 86 by the spring 92.

Roller 22 is also wiped and braked by a wiper element 126. Wiper element 126 is loosely positioned between the roller 22 and a vertical bracket 128 extending upwardly from the vertical lever 24. Wiper element 126 has a concave surface 130 that is urged into contact with the annular peripheral surface of the roller 22 by means of a biasing locking screw 132 which is similar to locking screw 124. The braking force applied by wiper elements 118 and 126 to rollers 18 and 22, respectively, insure that each of the rollers will be rotated in one direction only, although the direction is different for the two rollers as indicated by arrows 105 and 106.

The operation and advantages of the present invention will now be readily understood in view of the above description. When yarn clamp 10 of the present invention is applied to an outside filling supply loom, clamping rollers 18 and 22 are positioned between weft yarn inserting means 12 and weft yarn storage means 14, as shown in FIGS. 1 and 3 of the drawings. In this position, weft yarn Y extends from storage means 14, between annular surfaces 19 and 21 of rollers 18 and 22, respectively, to weft yarn inserting means 12. Drive shaft 34 is part of the loom driving mechanism and makes one rotation for each weft insertion by the weft yarn inserting means 12. Cam 32, thereby makes one rotation for each weft insertion by weft yarn inserting means 12. The timing of cam 32 is such that the oscillation of lever 24 by the follower mechanism causes clamping roller 22 to be moved toward and away from the first clamping roller 18 in timed relation with the weft yarn inserting sequence of the loom. During a weft yarn inserting sequence, which includes any intended axial movement of yarn Y from the weft yarn storage means 14, clamping roller 22 is moved away from the first clamping roller 18. After a weft yarn inserting sequence, clamping roller 22 is moved into engagement with clamping roller 18 so as to clamp weft yarn Y between annular surfaces 19 and 21. During each movement of clamping roller 22 away from clamping roller 18, both rollers are given a partial rotation of approximately 10° to 15° by the pawl and ratchet mechanism 70 and the connecting means 107. After several weft yarn insertions, the rollers 18 and 22 make a complete revolution so that the entire annular surface of each roller moves past its respective wiper element. Any lint that has accumulated on annular surfaces 19 and 21 of rollers 18 and 22, respectively, will be wiped away from these surfaces by the wipers 118 and 126. This insures that the annular surfaces 19 and 21 will be kept free of lint and that there is no possibility of a clump of lint being drawn into the loom by the weft inserting mechanism.

The yarn clamp 10 of the present invention is shown in association with a weft yarn inserting mechanism at one side of a loom. As shown in the drawings, the yarn clamp 10 is located at the right hand side of the loom when viewed from the front of the loom into which weft is inserted from right to left. In many looms, weft yarn is inserted from both sides of the loom. In such a case, a yarn clamp 10 would also be located at the left hand side of the loom and would be of opposite hand from that which is shown in the drawings. It is also contemplated that the yarn clamp of the present invention could be used in other types of machinery other than looms in which yarn or strand material is moved intermittently along its longitudinal axis and in which there is a need for clamping the yarn or strand material between periods of axial movement.

It is obvious that minor changes may be made in the form and construction of the invention without departing from the material spirit thereof. The invention is not to be confined to the exact form herein shown and described.

The invention having been thus described, what is claimed as new and desired to secure by Letters Patent is:

1. A yarn clamp for textile machines, comprising:

(a) a supporting frame;

(b) a first clamping roller mounted on the supporting frame for rotation about its axis;

(c) A second clamping roller mounted on the supporting frame for rotation about its axis;

(d) means for moving said first and second clamping rollers into and out of contact with each other;

(e) means for imparting at least a partial rotation to each of said clamping rollers while they are out of contact with each other; and (f) means for wiping the surfaces of the clamping rollers as they rotate to remove any lint that may have accumulated on their surfaces.

2. A yarn clamp as set forth in claim 1, wherein at least one of said clamping rollers is mounted for rotation on a lever that is pivotally attached to and a part of said supporting frame.

3. A yarn clamp as set forth in claim 2, wherein said means for moving said first and second clamping rollers into and out of contact with each other comprises a cam mechanism operated in timed relation with the loom for pivoting said lever to bring the clamping rollers into and out of contact with each other.

4. A yarn clamp as set forth in claim 1, wherein said means for moving the first and second clamping rollers into and out of contact with each other comprise resilient means that normally urge the rollers out of contact with each other and a cam and follower mechanism for moving said clamping rollers into engagement with each other against the bias of said spring.

5. A yarn clamp as set forth in claim 4, wherein said cam follower mechanism includes a resilient portion adapted for manual operation that permits one of said clamping rollers to be manually moved away from engagement with the other clamping roller.

6. A yarn clamp as set forth in claim 4, wherein the means for imparting a partial rotation to each of the clamping rollers comprises a pawl and ratchet mechanism operatively connected to said clamping rollers which partially rotates the clamping rollers as they move away from each other.

* * * * *